US010773924B2

(12) United States Patent
Kirsch et al.

(10) Patent No.: US 10,773,924 B2
(45) Date of Patent: Sep. 15, 2020

(54) GUIDE RAIL FOR AN ELEVATOR SYSTEM AND AN ELEVATOR SYSTEM

(71) Applicant: thyssenkrupp Elevator Innovation and Operations GmbH, Essen (DE)

(72) Inventors: Michael Kirsch, Kirchheim unter Teck (DE); Walter Hoffmann, Niedernhausen (DE); Thomas Kuczera, Leinfelden-Echterdingen (DE); Mike Obert, Gernsbach (DE)

(73) Assignee: ThyssenKrupp Elevator Innovation and Operations GmbH, Essen (DE)

( * ) Notice: Subject to any disclaimer, the term of this patent is extended or adjusted under 35 U.S.C. 154(b) by 280 days.

(21) Appl. No.: 15/529,980

(22) PCT Filed: Oct. 22, 2015

(86) PCT No.: PCT/EP2015/074456

§ 371 (c)(1),
(2) Date: May 25, 2017

(87) PCT Pub. No.: WO2016/083030

PCT Pub. Date: Jun. 2, 2016

(65) Prior Publication Data

US 2018/0327225 A1 Nov. 15, 2018

(30) Foreign Application Priority Data

Nov. 26, 2014 (DE) ..... 10 2014 117 370

(51) Int. Cl.

| | |
|---|---|
| ***B66B 7/02*** | (2006.01) |
| ***B66B 9/00*** | (2006.01) |
| ***B66B 11/04*** | (2006.01) |

(52) U.S. Cl.
CPC ..... *B66B 7/022* (2013.01); *B66B 9/00* (2013.01); *B66B 11/0407* (2013.01)

(58) Field of Classification Search
CPC ..... B66B 11/0407; B66B 9/00; B66B 7/022
See application file for complete search history.

(56) References Cited

U.S. PATENT DOCUMENTS

| | | | | |
|---|---|---|---|---|
| 3,321,059 A * | 5/1967 | Kroepel | ..... | B66B 23/22 198/335 |
| 5,203,430 A | 4/1993 | Grinaski et al. | | |
| 5,284,226 A | 2/1994 | Makimura et al. | | |
| 5,668,421 A * | 9/1997 | Gladish | ..... | B60L 13/10 104/23.2 |

(Continued)

FOREIGN PATENT DOCUMENTS

| | | |
|---|---|---|
| CN | 1607704 A | 4/2005 |
| CN | 1625523 A | 6/2005 |

(Continued)

OTHER PUBLICATIONS

Machine translation of DE 27 29 874 to Shimizu.*

(Continued)

*Primary Examiner* — Diem M Tran
(74) *Attorney, Agent, or Firm* — RMCK Law Group PLC

(57) ABSTRACT

The disclosure relates to a guide rail to guide the car of an elevator system. The guide rail is designed as a section with a cavity (**2*a*-2*f***) and/or integrated cooling fins to cool the guide rail.

26 Claims, 3 Drawing Sheets

(56) References Cited

U.S. PATENT DOCUMENTS

| | | | | |
|---|---|---|---|---|
| 5,783,877 | A * | 7/1998 | Chitayat | H02K 9/005 310/12.02 |
| 7,019,421 | B1 * | 3/2006 | Hall | B66B 11/0407 310/12.11 |
| 2001/0025411 | A1 * | 10/2001 | Probst | B23Q 1/38 29/740 |
| 2005/0077113 | A1 | 4/2005 | Deplazes et al. | |
| 2005/0156478 | A1 | 7/2005 | Berghanel et al. | |
| 2007/0107993 | A1 * | 5/2007 | Miller | B66B 7/02 187/406 |
| 2016/0083225 | A1 * | 3/2016 | Piech | H02K 41/031 187/250 |

FOREIGN PATENT DOCUMENTS

| | | | | |
|---|---|---|---|---|
| CN | 201842554 | U | 5/2011 | |
| DE | 2729874 | A1 * | 1/1978 | B60L 13/03 |
| DE | 3525025 | A1 | 1/1986 | |
| EP | 3858965 | B1 | 4/2000 | |
| JP | H01162692 | A | 6/1989 | |
| JP | H08268662 | A | 10/1996 | |
| WO | WO-2017027362 | A1 * | 2/2017 | B66B 11/0407 |

OTHER PUBLICATIONS

Chinese Office Action for CN Application No. 201580065225.8 dated Jun. 27, 2018, 6 pages.
2nd Chinese Office Action for CN Application No. 201580065225.8 dated Mar. 1, 2018, 7 pages.
International Search Report for International Application No. PCT/EP2015/074456 dated Jun. 1, 2016, 3 pages.

* cited by examiner

GUIDE RAIL FOR AN ELEVATOR SYSTEM AND AN ELEVATOR SYSTEM

CROSS-REFERENCE TO RELATED APPLICATIONS

This application is a 371 U.S. National Stage of International Application No. PCT/EP2015/074456, filed Oct. 22, 2015, which claims priority to German Application No. 10 2014 117 370.8 filed on Nov. 26, 2014. The disclosure of each of the above applications is incorporated herein by reference in their entirety.

FIELD

The present invention relates to a guide rail to guide the car of an elevator system and a corresponding elevator system.

BACKGROUND

Guide rails to guide the car of an elevator system as such are already known from the prior art. They serve as either a sliding guide or roller guide for elevator cars.

An elevator system operated by a linear drive is already known from EP 0858965 A1t. A roller guide is used in this, whereby the guide rail is rolled T-section of steel. There is a synchronous linear motor on both sides of the elevator car between the car walls and the walls of the shaft. This kind of linear motor has a primary part that runs in the longitudinal direction of the shaft, also called the stationary part, which bears stator windings. The primary part is attached to a stator carrier, which in turn is fastened to the shaft wall. The guide rail is also attached to the stator carrier. The secondary part of the linear motor is formed by the rows of permanent magnets that run in the longitudinal direction of the car wall. A row of permanent magnets runs on both sides of the stator windings. In this document, each linear motor has two rows of stator windings, each with two rows of permanent magnets. More details of the construction and mode of operation of the synchronous linear motors used therein can be found in this document, to which express reference is made here. A traveling magnetic field is generated in the rows of stator windings to drive the elevator car in a manner known per se. As a consequence, thrust is exerted in a vertical direction on the elevator car by the row of permanent magnets. The rows of permanent magnets thus form the secondary part of the respective linear motor.

The use of linear motors to drive elevator systems has proven expedient, particularly with so-called multi-car elevator systems. In these, several cars move independent of each other in a single shaft. It is also possible for cars to change shafts so as to allow a circular operation of the cars through at least two shafts. The primary part of a linear drive runs over the entire hoisting height together with the guide rail. In heavily frequented areas of the drive in particular, such as stopping and starting in the lobby, heat is generated at the primary part of the linear drive, which can lead to an unequal distribution of temperature and thus to changes in the motor parameters.

A temperature control for the guide rails of an elevator system is known from JP H-08268662 A. To this end, a cooling pipe is attached to the rear of the guide rails, which are designed as T-sections, in other words between the guide rail and shaft wall, through which a coolant is pumped. A temperature controller regulates the coolant's temperature. The cooling pipe has to be bridged by a flexible connecting piece at the fastening points of the guide pipe to the shaft wall. On the whole, the constructive outlay for this solution is very high.

A U-shaped guide rail as a sliding guide is known from CN 201842554 U. The guide surfaces have a line to distribute oil on the frictional surfaces for lubrication and cooling purposes. This solution does not appear to be very string and can only be used for sliding guides.

Steps should therefore be taken to reliably solve the problem of cooling the guide rails of elevator systems, in particular if linear drives are used, in a simple constructive manner and during permanent operation.

SUMMARY

This task is solved according to the present disclosure by a guide rail to guide a car and by a corresponding elevator system.

An elevator system according to the present disclosure has at least one guide rail. An elevator system often has two guide rails attached on opposite sides of the shaft wall, whereby a car is guided along these two guide rails by a roller guide on two of its outer walls on opposite sides.

In this connection it should be emphasized that when the indefinite article is used, such as "a cavity", "a car" etc., this does not mean "a single", but should express an indefinite number, such as "one or more cars", "one or more cavities" etc.

The sections as such are easy to construct. It is particularly expedient to integrate several cavities in the section, whereby the cavities can have the same or different geometries. It is particularly expedient if the cavities extend along the entire longitudinal side of a section. As explained below, the cavities serve to exchange heat with a fluid in the cavity, whereby this can be simply (ambient) air, though also water or a suitable refrigerant or coolant, which will be discussed in more detail later.

Alternatively, or in addition, it is also expedient if the section has integrated cooling fins. These cooling fins can in particular be developed on the insides of the named cavities. On the other hand, cooling fins can also be provided on the outer sides of the section. The cooling fins enlarge the surface of the section body in a manner known per se to improve the thermal transfer of heat to the surroundings and/or the fluid and this the cooling. Then again the cooling fins can advantageously be arranged along the entire longitudinal direction of a section.

The invention allows an embodiment of a guide rail with improved cooling of a simple design that works reliably in permanent operation. In particular, no additional elements are required on the guide rail itself for cooling. Cavities and/or cooling fins are an integral part of the section.

Sections can be rolled, drawn or pressed. An extruded section is particularly suitable as a section for the present invention. Aluminum is an advantageous material to use since the material aluminum allows larger surface areas with a lower weight compared to steel, for example. This brings some decisive advantages in the installation and maintenance of the guide rail.

The present invention is ideal for the elevator systems with a linear drive mentioned at the beginning. As has already been explained, heat develops on stationary parts of the linear drive at heavily frequented areas of the drive, for example in the lobby. A dissipation of this heat is eminently important for constant motor characteristics. This can be achieved if the stationary part of a linear motor is attached to the guide rail according to the invention. In particular, a direct attachment of the stationary part of the linear drive to the guide rail according to the invention is advantageous, especially if this attachment is designed to conduct heat. The heat produced by the linear motor can then be transferred directly to the rail section and thus dissipated effectively. This prevents the build-up of heat and fluctuating motor characteristics as a result of this.

It is also expedient if the section is essentially designed as a U-shaped section, on the inside of which the stationary part of the linear motor is attached. Aluminum connecting sections fastened on the inside of the rail section, for example, are suitable to attach the stationary part, in other words the stator windings. On account of the cavities that exist according to the invention and/or cooling fins, this is more of a U-like section than a U-shaped section in the stricter sense, as will become clear taking the embodiments as an example.

As has already been mentioned, it is advantageous if the cavity or cavities are arranged in the longitudinal direction of the section.

In order to increase the efficiency of the heat exchange with a gaseous or liquid fluid in the cavity, this cavity interacts operatively with means of conveyance for the fluid. For example, the fluid can be circulated in the cavity by a pump. It is also advantageous if the cavity interacts operatively with means to adjust the temperature of the fluid. The temperature of the circulating fluid can thus be adjusted to a suitable value by a simple temperature control.

The simplest fluid is air, such as ambient air, or water, as long as there is no risk of corrosion. However, refrigerant or coolant can also be used advantageously. Coolant transports thermal energy along a temperature gradient from a point of higher to a point of lower temperature, whereas refrigerant can transport thermal energy in the opposite direction to a temperature gradient. Natural coolants include ammonia, carbon dioxide, water, hydrocarbons or air. Synthetic coolants are based on halogenated hydrocarbons and are known under the familiar abbreviations HCFC, HFC, CFC or PFC.

Due to the larger surface area on account of the cavities and/or cooling fins, excess heat can be easily dissipated to the ambient air and/or any fluid in the cavity. The heat emission can be further increased by painting or anodizing the surface of the rail in a dark color. A coating provided by painting or in particular anodizing can at the same time protect against corrosion.

The invention also relates to an elevator system with a guide rail according to the invention, as has been described more detail above. One kind of elevator system is, in particular, the "multi-car" elevator system mentioned at the beginning, in which several cars can be operated independent of each other in one or more shafts. Linear drives are preferably used for such multi-car elevator systems, for which the guide rails according to the invention are again particularly suited. The elevator system according to the invention can also in principle be a cantilever elevator.

Further advantages and embodiments of the invention result from the description and the enclosed drawing.

It is understood that the aforementioned features and those still to be explained below can be used not only in the combinations specified but also in other combinations or on their own without going beyond the scope of the present invention.

The invention is shown diagrammatically on the basis of an embodiment in the drawing and will be described in more detail in the following with reference to the drawing.

DETAILED DESCRIPTION

Figure 1:
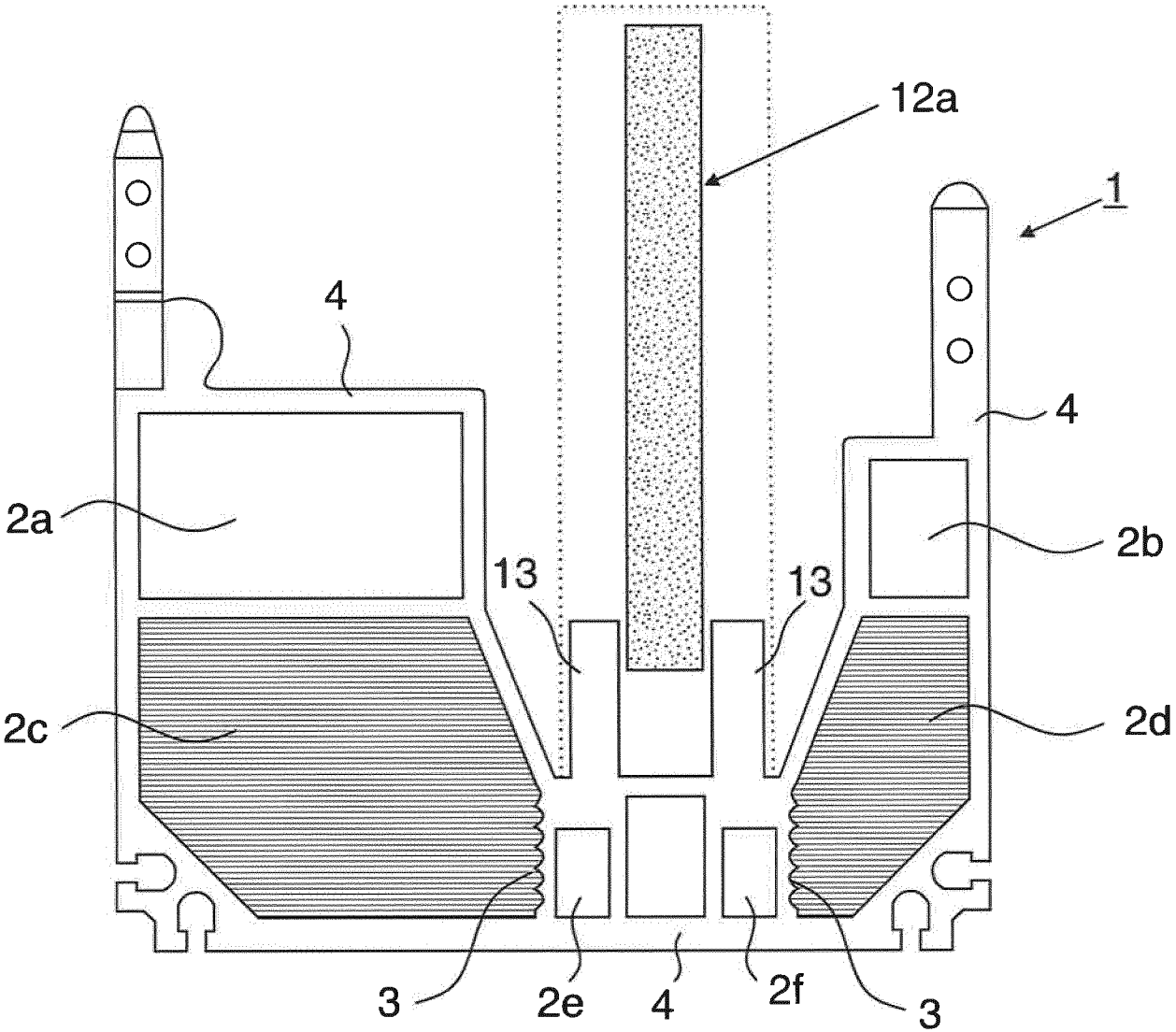
FIG. 1 shows the cross section of a guide rail to guide a car in an elevator system in accordance with a first embodiment.

FIG. 1 shows a first embodiment of a guide rail 1 in cross-section vertical to the longitudinal direction of the guide rail 1. The guide rail 1 displays several cavities 2*a*-2*f*. The guide rail 1 is formed by an aluminum extruded section 4. Further elements, for example for guide or brake surfaces, can be attached to the section 4. On the whole, the section 4 is designed U-like. The stationary part 12*a* of a linear motor 12 with its stator windings is attached to the inside of the section 4 (compare FIG. 3). The diagrammatic representation shows connecting sections 13 to attach the stationary part 12*a* to the section 14, whereby the connecting sections 13 are advantageously made of aluminum too. The direct thermally conductive connection via the connecting piece 13 allows a good dissipation of heat to the section 4 of the guide rail 1.

The guide rail 1 stretches over the entire route of a car in an elevator shaft. It is advantageous if the named cavities 2*a*-2*f* are arranged along the entire longitudinal direction of the section 4. In order to increase the efficiency of the guide rail 1 cooling, it is sensible if fluid in one ore more cavities 2*a*-2*f* is guided or circulated through the respective cavities. To this end, the corresponding cavity interacts operatively with a corresponding means of conveyance, such as a pump, for the fluid. It is also advantageous if a means of adjusting the temperature of the corresponding fluid is provided, so as to achieve a desired target temperature in the cavity (see FIG. 3).

FIG. 1 shows that the cavities 2*c* and 2*d* are filled with a gas, such as ambient air, whereby this gas is in particular transported along the entire longitudinal direction of the section 4. It is of course also possible to introduce ambient air into one end of the cavity by means of a fan and to discharge the heated ambient air at the other end of the cavity into the surroundings again. Alternatively, closed cooling circuits with means to adjust the temperature can also be used.

Section 4 of guide rail 1 in accordance with FIG. 1 also shows integrated cooling fins 3, which in this embodiment are arranged on the inside of the cavity 2*d*. This kind of cooling fin 3 enlarges the surface are of the section and thus improves the efficiency of the exchange of heat with the gas in the cavity 2*d*. In the same way, cooling fins 3 are arranged on the inside of cavity 2*c*.

Figure 2:
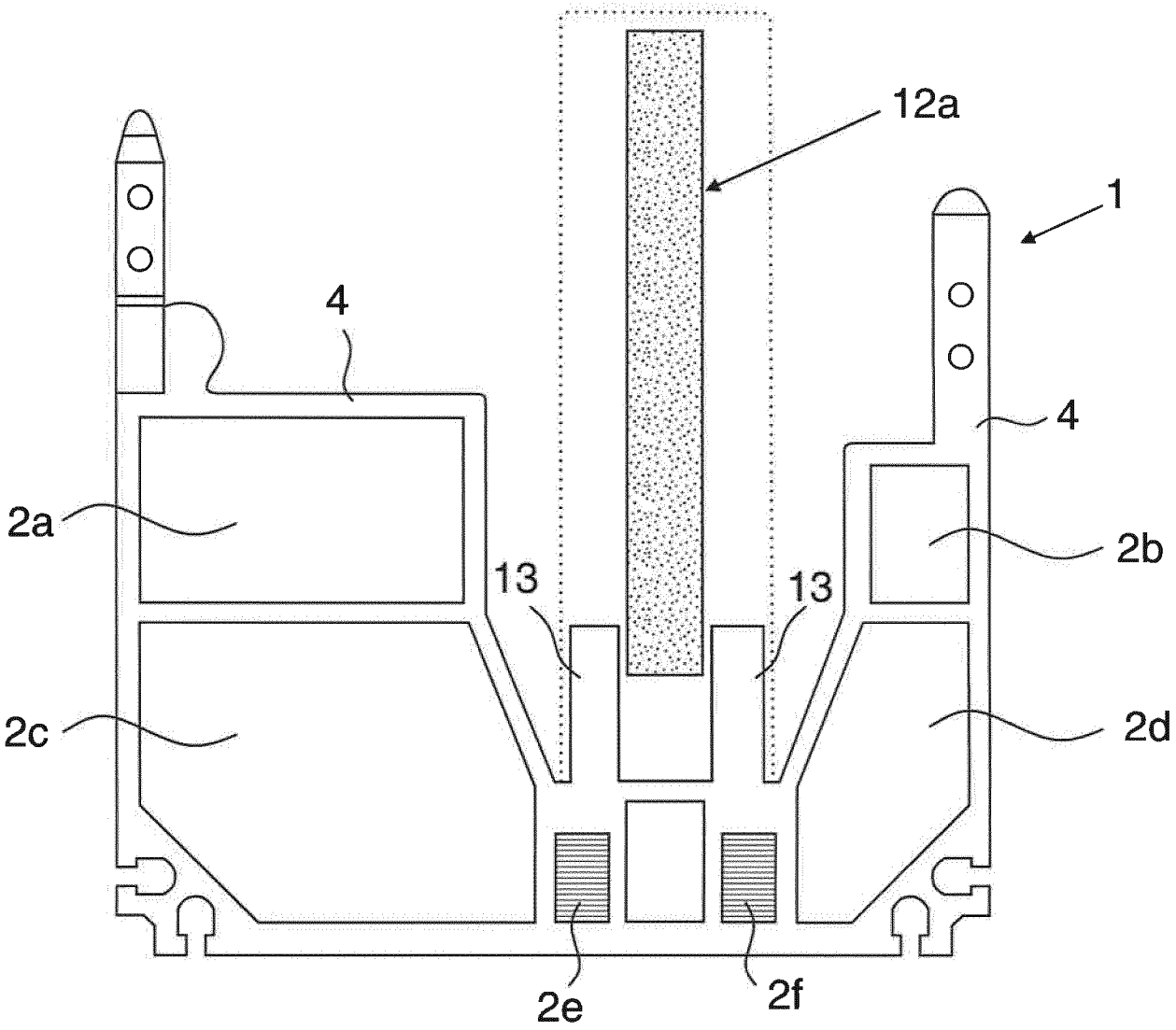
FIG. 2 shows the cross section of a guide rail to guide a car in an elevator system in accordance with a second embodiment, FIG. 3 diagrammatically shows a cross-section through an elevator system in a side view with a guide rail a linear motor.

FIG. 2 shows a guide rail 1, whereby the same reference signs refer to the same elements as in FIG. 1. These elements will not be explained again here to a large extent so as to avoid repetition. The cavities 2*e* and 2*f* in the embodiment in accordance with FIG. 2 contain fluids that serve as refrigerant or coolant, which can be transported by suitable pumps in the longitudinal direction of the cavity. The cavities 2*e* and 2*f* are located directly after the stationary part 12*a* of the linear motor 12, so that any heat produced here can be dissipated as quickly as possible. It goes without saying that the cavities 2*c* and 2*d* in the embodiment in accordance with FIG. 2 can also be used in the same way as in the embodiment in accordance with FIG. 1.

The cavities 2*a* and 2*b* can also be used in the same way as the cavities 2*c* and 2*d* or 2*d* and 2*f*. Alternatively, they can serve to guide or attach further elements required by a guide rail 1 for elevator systems.

Figure 3:
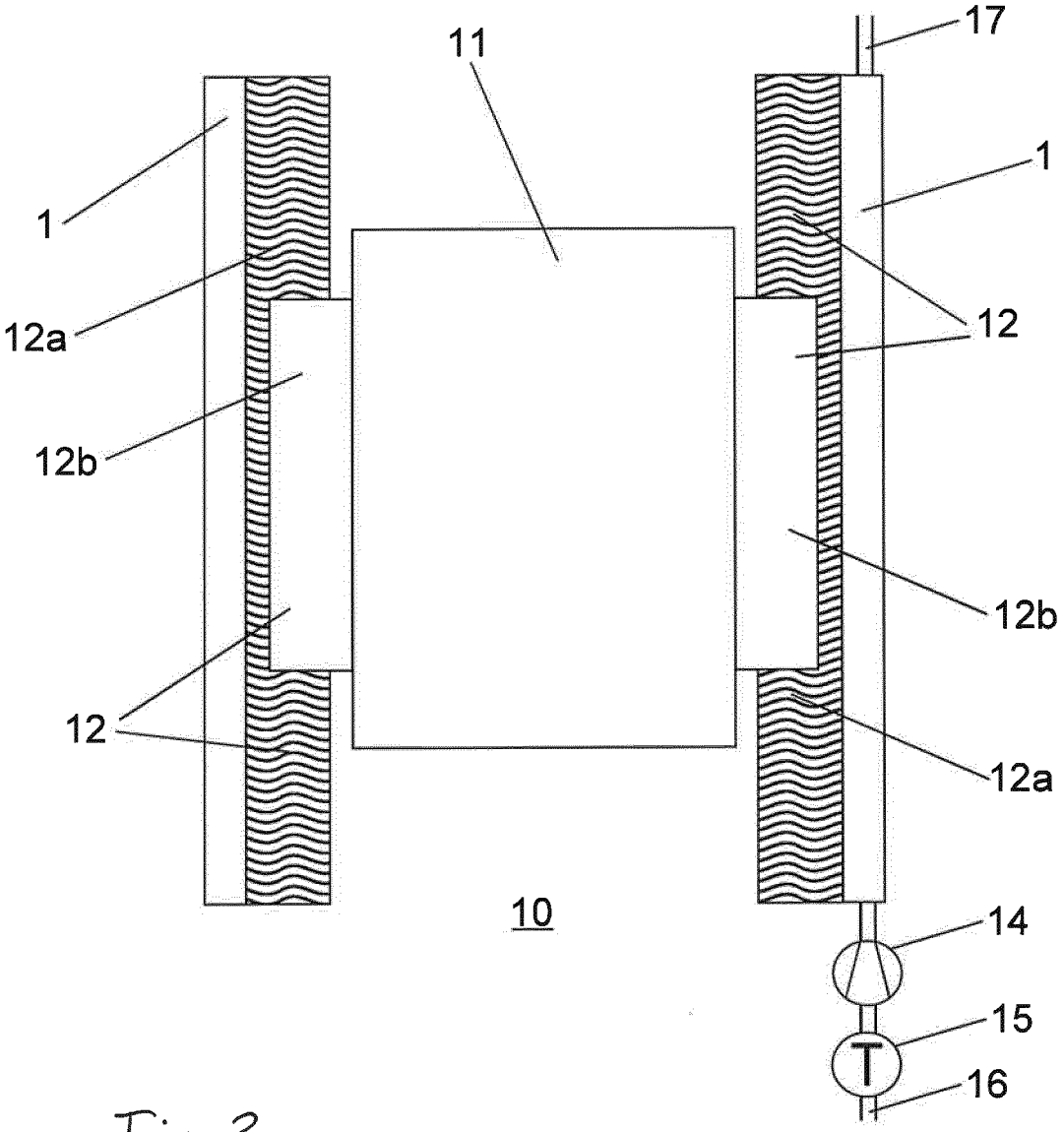

FIG. 3 shows diagrammatically in cross-section a side view of an elevator system 10. The elevator system 10 has at least one car 11, on both sides of which a secondary part 12*b* of a linear motor 12 is attached. The guide rails are marked 1. The stationary part 12*b* of a linear motor 12 is connected to a guide rail 1.

In a manner known per se, the thrust generated by one of the linear motors 12 accelerates or brakes the elevator car 11 in a vertical direction. In multi-car elevator systems, this type of drive is particularly advantageous because no elevator rope constructions are needed.

The guide rails 1 used in the elevator system 10 in accordance with FIG. 3 are designed as a section with one or more cavities and/or integrated cooling fins to cool the respective guide rail 1. The guide rails 1 shown in FIGS. 1 and 2, for example, are particularly suitable for this purpose.

The means of conveyance for the cooling fluid already mentioned above are marked 14 and in this case represent a pump for the coolant. The means to adjust the temperature are marked 15. The cooling fluid is guided into the cavities through a line 16 and leaves these through the line 17. It is advantageous to connect the lines 16 and 17 to allow the coolant to circulate and to regulate the temperature to a pre-set value.

REFERENCE SIGN LIST

1 Guide rail
2*a*-2*f* Cavity
3 Cooling fins
4 Section
5 Fluid
6 Fluid
10 Elevator system
11 Car
12 Linear motor
12*a* Stationary part, primary part
12*b* Secondary part
13 Connecting section
14 Means of conveyance
15 Means of adjusting the temperature
16 Pipe
17 Pipe

The invention claimed is:

1. A guide rail to guide a car of an elevator system, wherein the guide rail is formed by an extruded, one-piece section, the guide rail comprising:

a connecting section configured to couple to a stationary part of a linear motor having a secondary part attached to the car, wherein the linear motor is configured to accelerate and brake the car in the elevator system in a vertical direction;

integrated cooling fins to cool the guide rail, the integrated cooling fins being separate and distinct from the stationary and secondary parts of the linear motor; and at least one vertically extending cavity integrated within the one-piece section and configured to receive a coolant fluid therein to cool the guide rail.

2. The guide rail in accordance with claim 1, wherein the connecting section is disposed between a pair of guiding surface projections.

3. The guide rail in accordance with claim 2, wherein the extruded, one-piece section is made from aluminum.

4. The guide rail in accordance with claim 1, wherein the one-piece section is U-shaped.

5. The guide rail in accordance with claim 1, wherein the cooling fins extend into the cavity from an inner wall that defines the at least one vertically extending cavity.

6. The guide rail in accordance with claim 1, further comprising:

coolant lines fluidly coupled to the cavity;

a pump operatively coupled to the coolant lines; and a cooling device operatively coupled to the coolant lines.

7. The guide rail in accordance with claim 1, wherein the at least one cavity interacts operatively with a means of adjustment for adjusting a temperature of the coolant fluid.

8. The guide rail in accordance with claim 7, wherein the coolant fluid is one of (a) air, (b) water, (c) a refrigerant, (d) a coolant, (e) a mixture of water and a refrigerant; and (f) water and a coolant.

9. The guide rail in accordance with claim 1, wherein the guide rail is one of painted and anodized at least partly in a dark color.

10. An elevator system comprising:

a car;

a guide rail to guide the car of the elevator system in a vertical direction;

a linear motor having a stationary part attached to the guide rail and a secondary part attached to the car, wherein the linear motor is configured to accelerate and brake the car in the elevator system in the vertical direction; and wherein the guide rail is formed by a one-piece section with integrally formed vertically extending cavities configured to receive coolant fluid therein, and cooling fins to cool the guide rail, the cooling fins being separate and distinct from the stationary and secondary parts of the linear motor.

11. The elevator system in accordance with claim 10, wherein the one-piece section is a one-piece extruded element.

12. The elevator system in accordance with claim 11, wherein the section is made from aluminum.

13. The elevator system in accordance with claim 10, wherein the one-piece section is U-shaped section, wherein the stationary part of the linear motor is attached to an inside of the U-shaped section.

14. The elevator system in accordance with claim 10, wherein the one-piece section includes a connecting section for attaching the stationary part to the one-piece section.

15. The elevator system in accordance with claim 10, wherein the guide rail is one of painted and anodized at least partly in a dark color.

16. An elevator system comprising:

a car;

a guide rail to guide the car of the elevator system in a vertical direction;

a linear motor having a stationary part attached to the guide rail and a secondary part attached to the car, wherein the linear motor is configured to accelerate and brake the car in the elevator system in the vertical direction;

wherein the guide rail is formed by an extruded single piece section with at least one integrated vertically extending cavity, wherein the at least one cavity receives a coolant fluid therein configured to cool the guide rail, wherein the stationary part is attached to the section;

a means of conveyance for the coolant fluid through the cavity; and a means of adjustment for adjusting a temperature of the coolant fluid.

17. The elevator system in accordance with claim 16, whereby the fluid is one of air, water or a refrigerant and a coolant.

18. The elevator system of claim 16 wherein the guide rail includes cooling fins to cool the guide rail, the cooling fins being integrally formed with the extruded single piece section and separate and distinct from the stationary and secondary parts of the linear motor.

19. A guide rail to guide a car of an elevator system, wherein the guide rail is formed by an extruded, one-piece section, the guide rail comprising:

a connecting section configured to couple to a stationary part of a linear motor having a secondary part attached to the car, wherein the linear motor is configured to drive the car in the elevator system in a vertical direction; and at least one vertically extending enclosed cavity internally integrated within the one-piece section and having a coolant fluid therein to cool the guide rail.

20. The guide rail in accordance with claim 19, wherein inner walls defining each vertically extending cavity are in direct thermal connection with the stationary part of the linear motor via the connecting section, and wherein the inner walls contain the coolant fluid within each vertically extending cavity.

21. The guide rail in accordance with claim 20, wherein the section is made from aluminum.

22. The guide rail in accordance with claim 19, wherein the one-piece section is U-shaped, wherein the stationary part of the linear motor is attached to an inside of the U-shaped section.

23. The guide rail in accordance with claim 19, wherein the at least one cavity interacts operatively with a means of conveyance for the coolant fluid.

24. The guide rail in accordance with claim 23, wherein the at least one cavity interacts operatively with a means of adjustment for adjusting a temperature of the coolant fluid.

25. The guide rail in accordance with claim 24, wherein the coolant fluid is one of air, water, a refrigerant, a coolant or a mixture of water and a refrigerant or water and a coolant.

26. The guide rail in accordance with claim 19, wherein the guide rail is one of painted and anodized at least partly in a dark color.

* * * * *